United States Patent [19]

Bailie et al.

[11] Patent Number: 4,879,765

[45] Date of Patent: Nov. 14, 1989

[54] INFANT KNEE PAD

[76] Inventors: Daphne Bailie; Brian Bailie, both of 129 Sylvan Avenue, Scarborough, Canada

[21] Appl. No.: 249,723

[22] Filed: Sep. 27, 1988

[30] Foreign Application Priority Data

Oct. 1, 1987 [CA] Canada ..... 548395

[51] Int. Cl.[4] ..... A41D 13/06

[52] U.S. Cl. ..... 2/24; 2/62; 2/267

[58] Field of Search ..... 2/23, 24, 62, 269, 208, 2/209, 209.1, 267, 268

[56] References Cited

U.S. PATENT DOCUMENTS

| | | | |
|---|---|---|---|
| 1,846,835 | 2/1932 | Bruckler | 2/24 X |
| 1,862,303 | 6/1932 | Glahe | 2/24 |
| 2,552,177 | 5/1951 | Hurt | 2/24 |
| 2,626,394 | 1/1953 | Davis | 2/24 |
| 2,794,982 | 6/1957 | Kay | 2/24 |
| 3,937,218 | 2/1976 | Gaylord, Jr. | 2/24 X |
| 3,990,440 | 11/1976 | Gaylord, Jr. | 2/24 X |
| 4,198,708 | 4/1980 | Fugere et al. | 2/24 X |
| 4,333,181 | 6/1982 | Corriero | 2/24 OR |

FOREIGN PATENT DOCUMENTS

| | | | |
|---|---|---|---|
| 18997 | 10/1895 | United Kingdom | 2/267 |

*Primary Examiner*—Werner H. Schroeder
*Assistant Examiner*—Jeanette E. Chapman
*Attorney, Agent, or Firm*—Volpe and Koenig

[57] ABSTRACT

The present invention provides a child's knee pad with a convex inner and a concave outer surface and thinning downwardly in pad thickness for preshaping and fitting to a child's knee.

8 Claims, 2 Drawing Sheets

FIG. 1.
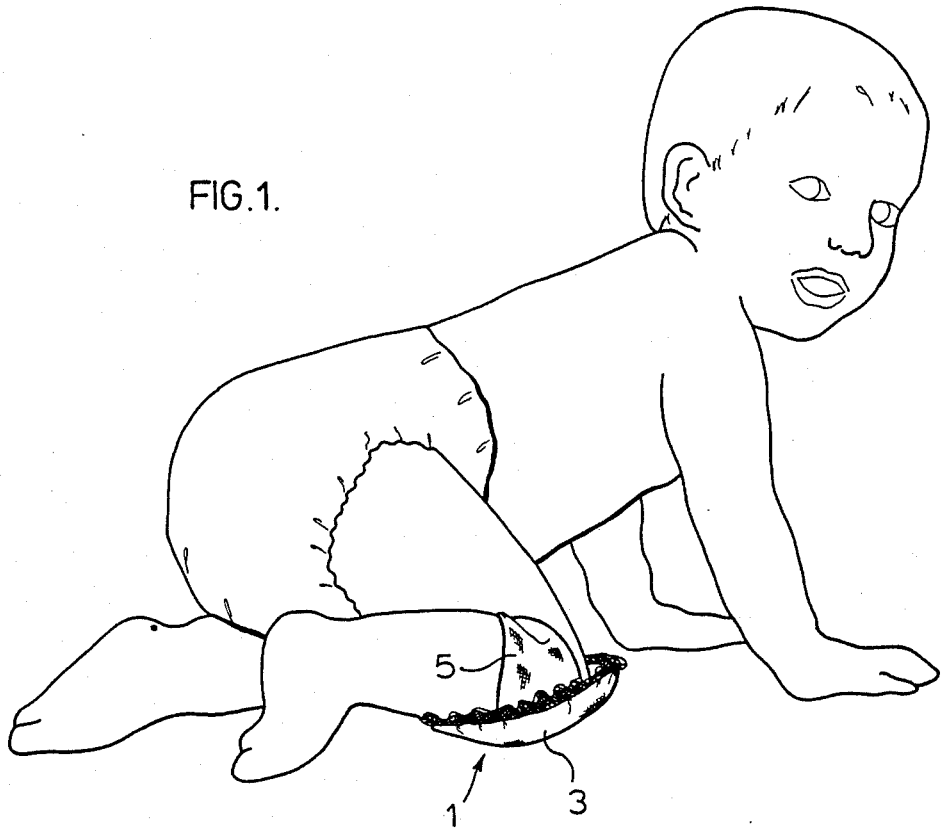
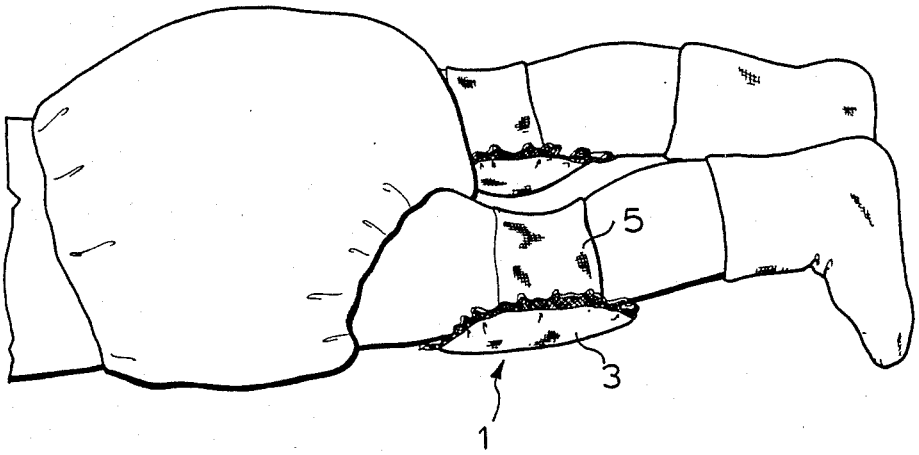
FIG. 2.

INFANT KNEE PAD

FIELD OF THE INVENTION

The present invention relates to a knee pad specifically designed for young children.

BACKGROUND OF THE INVENTION

There is very little presently available in the way of knee protection for a young child. Typically, children who crawl tend to very quickly wear the knees out on pants, stockings and the like and although some pants are built with reinforced knee regions, this does not provide a suitable answer to the problem.

SUMMARY OF THE INVENTION

The present invention provides a knee pad specifically designed for children. The knee pad comprises a forward pad portion and a rearward securing strap. The pad portion itself is somewhat oval shaped with a convex inner and concave outer surface and thins downwardly in pad thickness for preshaping and fitting to a childs knee.

According to an aspect of the present invention the securing strap, which is elasticized has a width of about ½ to ⅓ of the length of the pad for comfortable securing about the knee.

BRIEF DISCUSSION OF THE DRAWINGS

The above as well as other advantages and features of the present invention will be described in greater detail according to the preferred embodiments of the present invention in which:

FIGS. 1 and 2 show a knee pad according to a preferred embodiment of the present invention in use by a young child.

DETAILED DESCRIPTION ACCORDING THE PREFERRED EMBODIMENTS OF THE PRESENT INVENTION

FIGS. 1 and 2 show a knee pad generally indicated at 1 fitted about the knee of a crawling infant. This knee pad comprises a forward pad portion 3 and a rearward elasticized secuing strap 5. Here it is to be noted that the strap has a width to extend completely front top to bottom across the back of the knee and therefore substantially eliminate any otherwise uncomfortable pressure points on the back of the infants leg.

Figure 3:
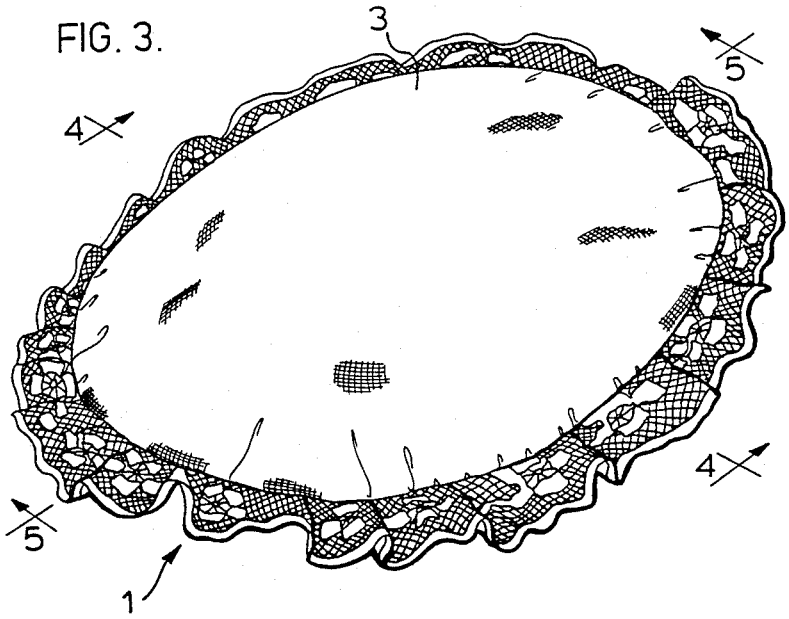
FIG. 3 is a top perspective view of the knee pad of FIGS. 1 and 2.
Figure 4:
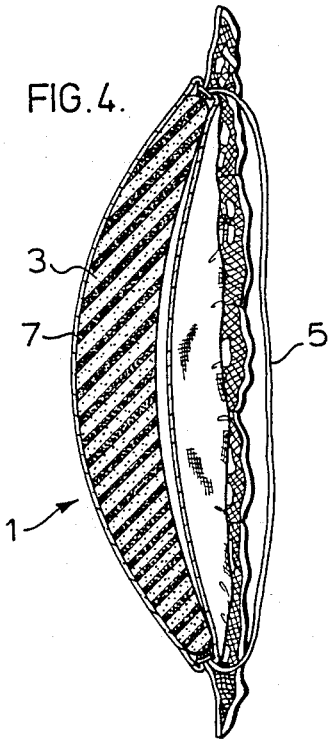
FIG. 4 is a sectional view along the lines 4—4 of FIG. 3.
Figure 5:
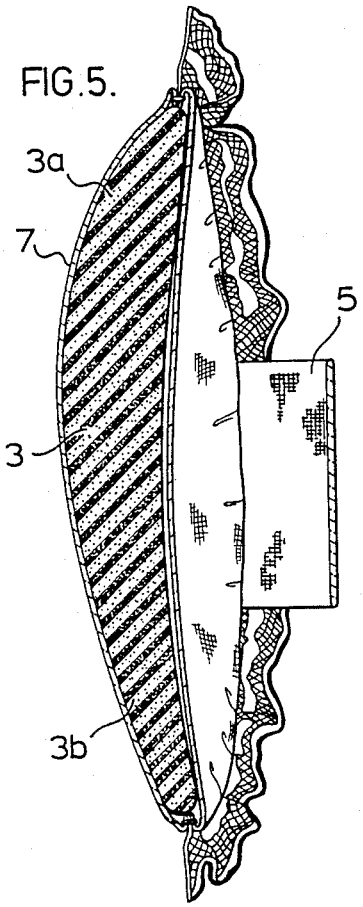
FIG. 5 is a sectional view along the lines 5—5 of FIG. 3.

The physical make-up of the pad is best seen in Figures 3 through 5 of the drawings. More particularly, the forward pad portion, which is of a light weight sponge construction is covered externally by a covering layer 7. The rearward strap 5 is secured in a reinforced manner directly to the outer cover for the forward pad portion.

The forward pad portion is preshaped or contoured to comfortably fit to the knee of the child. In this regard, the pad portion, which is generally oval shaped, has a concave inner and a convex outer surface to form a padded cup directly over the knee. Thus eliminates the requirement for the child to have to bend the pad when in use to shape to the knee. In addition, as best seen in FIG. 5 of the drawings, the forward pad portion has an upper end **3*a* which is substantially thicker than the lower end 3*b*** on the forward pad portion. Again, this provides maximum padding over the knee itself with the thinner pad portion falling below the knee and effectively curving into the shin area so as not to elevate the child's leg to a position where it might otherwise be awkward to crawl.

The rearward elasticized strap 5 has a width relative to the length of the pad portion substantially increased to that of a conventional knee pad. In particular, the width of strap 5 is about ⅓ to ½ the length of the pad portion so as to span the back of a child's knee for comfort purposes. At the same time, the pad portion itself is substantially smaller than that of a conventional knee pad, particularly for fitting to the knee of a young child. In the preferred embodiment as shown, the strap is about 2 inches wide and the pad is about 5 inches long.

As an additional feature, the strap 5 may be adjustable in length using for example a VELCRO TM adjustment which also makes the pad extremely easy to put on and remove from the child.

Although various preferred embodiments have been described in detail, it will be appreciated that variations may be made without departing from the spirit of the invention or the scope of the appended claims.

The embodiments of the invention in which an exclusive property or privilege is claimed are defined as follows:

1. A child's knee pad comprising a forward pad and a rearward securing elasticized strap having a width of about ½ to ⅓ of the length of the pad which is somewhat oval shaped with a convex inner and a concave outer surface and thinning downwardly in thickness for preshaping and fitting to a child's knee.

2. A child's knee pad comprising: a forward pad and a rearward securing elasticized strap; the pad is somewhat oval shaped with a convex inner and a concave outer surface and thins downwardly from the topmost portion thereof to the bottommost portion thereof for preshaping and fitting to a child's knee; and, the strap has a width of about ½ to ⅓ of the length of the pad.

3. A child's knee pad as claimed in claim 2 wherein said pad comprises a sponge material covered with a fabric surface to which said strap is attached.

4. A child's knee pad as claimed in claim 2 wherein the length of said pad is approximately 5 inches.

5. A child's knee pad as claimed in claim 2 wherein the width of said strap is about 2 inches.

6. A child's knee pad as claimed in claim 1, wherein said pad comprises a sponge material covered with a fabric surface to which said strap is attached.

7. A child's knee pad as claimed in claim 1, wherein the length of said pad is about 5 inches.

8. A child's knee pad as claimed in claim 1, wherein the width of said strap is about 2 inches.

* * * * *